United States Patent [19]

Kubisch et al.

[11] Patent Number: 5,070,930

[45] Date of Patent: Dec. 10, 1991

[54] COUNTERGRAVITY CASTING APPARATUS

[75] Inventors: John G. Kubisch, Midland; James B. Mercer; Thomas E. Wenzel, both of Saginaw, all of Mich.

[73] Assignee: General Motors Corporation, Detroit, Mich.

[21] Appl. No.: 574,212

[22] Filed: Aug. 24, 1990

[51] Int. Cl.[5] ..... B22D 18/06

[52] U.S. Cl. ..... 164/255; 164/63; 164/323

[58] Field of Search ..... 164/255, 254, 256, 306, 164/309, 63, 339, 341, 137, 323

[56] References Cited

U.S. PATENT DOCUMENTS

| | | | |
|---|---|---|---|
| 1,216,362 | 2/1917 | Richards et al. . | |
| 1,516,973 | 11/1924 | Loughran . | |
| 3,589,199 | 6/1971 | Levin | 164/255 X |
| 3,731,822 | 5/1973 | Friesen et al. | 214/1 BC |
| 4,340,108 | 7/1982 | Chandley et al. | 164/63 |
| 4,606,396 | 8/1986 | Chandley et al. | 164/255 |
| 4,745,962 | 5/1988 | Mercer et al. | 164/255 |

FOREIGN PATENT DOCUMENTS

| | | | |
|---|---|---|---|
| 58-100964 | 6/1983 | Japan | 164/341 |
| 59-1060 | 1/1984 | Japan | 164/63 |
| 59-45072 | 3/1984 | Japan | 164/63 |

*Primary Examiner*—J. Reed Batten, Jr.

*Attorney, Agent, or Firm*—Reising, Ethington, Barnard, Perry & Milton

[57] ABSTRACT

Casting apparatus comprises a casting mold including first and second elongated pick-up ledges on first and second upstanding mold sides and a mold pick-up mechanism having first and second elongated, pivotal pick-up feet for supportingly engaging the mold ledges to carry the mold through a casting cycle.

16 Claims, 5 Drawing Sheets

VACUUM SOURCE
142
144

122
123
90
122
123
62
132
132
86
70
82
62
100
61
100a
62
54
98
96
52
54a
98a
96a
102
60a
121
52a
OP
120
118b
112
110
OP
116b
118a
118
116a
116
60
60b
60c
136
61
122
122
61
70
100
140
24
52
54
2
54a
20
52a
118
34
36
136
26
44
116
36a
34a
22
45

VACUUM SOURCE
142
144
122
90
122
132
62
62
132
61
70
100a
100
84
98
96
80
54
24
52
20
52a
P
54a
120
121
36
34
118
42
116
S
14
30
32
26
33
136
18
22
16
28

COUNTERGRAVITY CASTING APPARATUS

FIELD OF THE INVENTION

This invention relates to apparatus for the countergravity casting of a melt and, more particularly, to a mold pick-up mechanism and a casting mold engaged by the pick-up mechanism for transport through the casting cycle.

BACKGROUND OF THE INVENTION

A vacuum-assisted, countergravity casting apparatus using a gas permeable mold is described in the Chandley et al U.S. Pat. No. 4,340,108 issued Jul. 20, 1982 and U.S. Pat. No. 4,606396 issued Aug. 19, 1986. Typically, the casting apparatus includes a casting mold having a porous, gas permeable upper mold member (cope) and a lower mold member (drag) sealingly secured together at a common horizontal parting plane, a vacuum box confronting the gas permeable upper mold member and means for immersing the underside of the lower mold member in an underlying pool of melt (e.g., molten metal) while evacuating the vacuum box to draw the melt upwardly through one or more ingate passages in the lower mold member into one or more mold cavities formed between the upper and lower mold members. Typically, the upper and lower mold members comprise gas permeable, resin-bonded sand mold members which are self-supporting and adhesively secured (glued) together at the common horizontal parting plane to minimize leakage of the melt at the parting plane.

The casting mold and the vacuum box are sealed together using a gasket seal compressed between the bottom lip of the vacuum box and an upwardly facing sealing surface or flange on the upper or lower mold member. Various mechanical clamping arrangements have been provided for clamping the vacuum box and the mold together to compress the seal therebetween; for example, as shown in U.S. Pat. Nos. 4,340,108; 4,616,691; 4,632,171 and 4,658,880. In these clamping arrangements, the casting mold typically includes a plurality of relatively complex structural attachment features, such as threaded lugs, threaded bores, slotted keyways and the like, for engagement with the clamping mechanism. The attachment features provide multiple pick-up locations on the mold for engagement with the clamping mechanism in a manner that oftentimes produces considerable local stresses on the mold at these locations, especially when relatively large, heavy molds are used. To this end, the size of the casting mold is sometimes limited to reduce mold weight and stresses imposed on the mold at the pick-up locations. Moreover, the clamping mechanism oftentimes engages the casting mold at pick-up locations disposed in such proximity to the mold underside as to subject the clamping mechanism to accidental and detrimental immersion in the melt during countergravity casting.

It is an object of this invention to provide a unique countergravity casting apparatus including a casting mold having relatively simple, pick-up features on the mold sides for engagement by a mold pick-up mechanism in a manner to uniformly distribute pick-up stresses over a large area of the mold and in a manner to provide a large mold immersion zone between the mold underside and the mold pick-up mechanism.

It is another object of this invention to provide a unique countergravity casting apparatus including a casting mold having pick-up features thereon in a generally level orientation and a mold pick-up mechanism for engaging the mold pick-up features in a manner that accommodates any unevenness in the mold pick-up features or unparallelism between the pick-up features and pick-up mechanism.

The aforementioned objects and advantages of the present invention will become more readily apparent from the following detailed description and drawings.

SUMMARY OF THE INVENTION

The invention contemplates a casting apparatus wherein a casting mold includes first and second upstanding sides having a respective first and second elongated ledge disposed thereon in a generally level orientation and wherein a mold pick-up mechanism is adapted to supportively engage the mold ledges to thereby carry the mold through a casting cycle. The mold pick-up mechanism includes first and second pick-up arms each movable relative to the respective first and second mold sides between an open position remote therefrom and a closed position proximate thereto. Each pick-up arm includes an elongated, pivotal pick-up foot for engaging an elongated ledge on the mold side and accommodating any unevenness along the ledge or unparallelism between the ledge and the pick-up foot when the pick-up foot engages therewith so as to provide substantially uniform distribution of the mold's weight over the ledges.

The casting apparatus includes means for relatively moving the casting mold and the pick-up mechanism toward one another while the pick-up arms are in the open positions so as to position the pick-up arms laterally adjacent the mold sides where the pick-up arms can be moved to the closed positions proximate the mold sides to locate the pick-up feet beneath the ledges. The casting mold and the pick-up mechanism are then moved away from one another by suitable means to engage the pick-up feet with the mold ledges thereabove to thereby support the mold on the pick-up mechanism. The pick-up feet pivot as necessary during engagement with the ledges to accommodate any unevenness therealong and/or unparallelism therebetween.

In one embodiment of the invention for vacuum-assisted, countergravity casting, the casting apparatus includes a vacuum box sealing engaging the mold and defining a vacuum chamber confronting an upper portion of the mold. The mold pick-up mechanism straddles the vacuum box such that the pick-up feet can supportively engage the mold ledges while the vacuum box is sealingly engaged to the mold. Preferably, the vacuum box is relatively movably mounted on the pick-up mechanism such that the vacuum box initially engages the mold as the pick-up mechanism and the mold are relatively moved toward one another (with the pick-up arms in the open positions) and such that the pick-up arms are positioned laterally adjacent the mold sides with continued relative movement of the pick-up mechanism and the mold toward one another. Once the pick-up arms are positioned laterally adjacent the mold sides, they are moved to the closed positions proximate the mold sides to position the pick-up feet beneath the mold ledges for supportive engagement therewith via subsequent relative movement of the pick-up mechanism and the mold away from one another.

In a working embodiment of the invention, the casting mold comprises a lower mold member having the elongated, generally level ledges on the upstanding sides thereof and an upper mold member disposed atop the lower mold member. The vacuum box sealingly engages the lower mold member and confronts the upper mold member so as to leave the ledges outboard of the vacuum box and engageable by the pick-up feet. The ledges preferably extend substantially from the front to the rear of the lower mold member and are spaced above the mold underside to provide a melt immersion zone for deep immersion of the lower mold member in an underlying pool of melt.

DETAILED DESCRIPTION OF THE INVENTION

Figure 1:
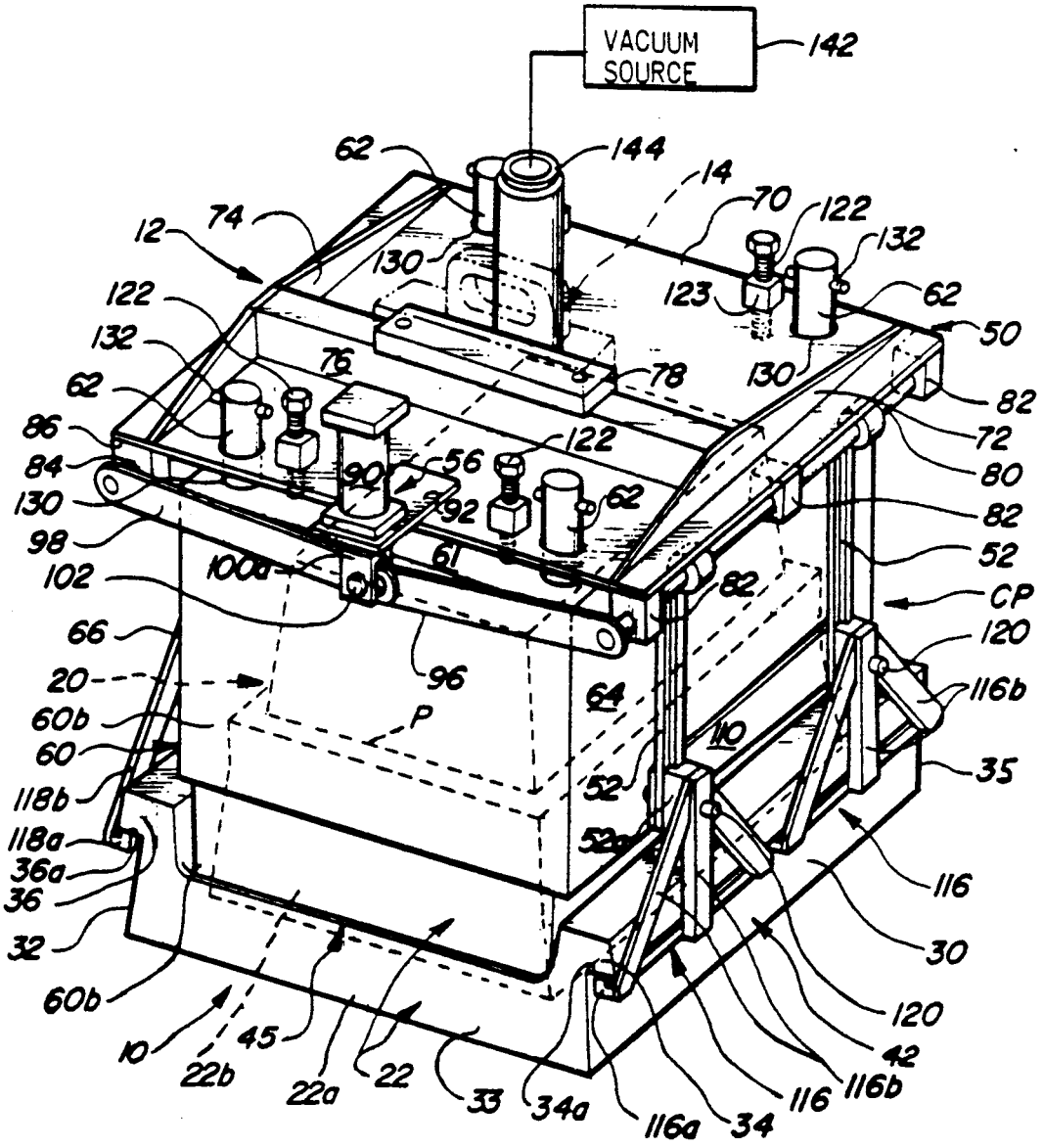
FIG. 1 is a perspective view of a casting apparatus in accordance with one embodiment of the invention.
Figure 5:
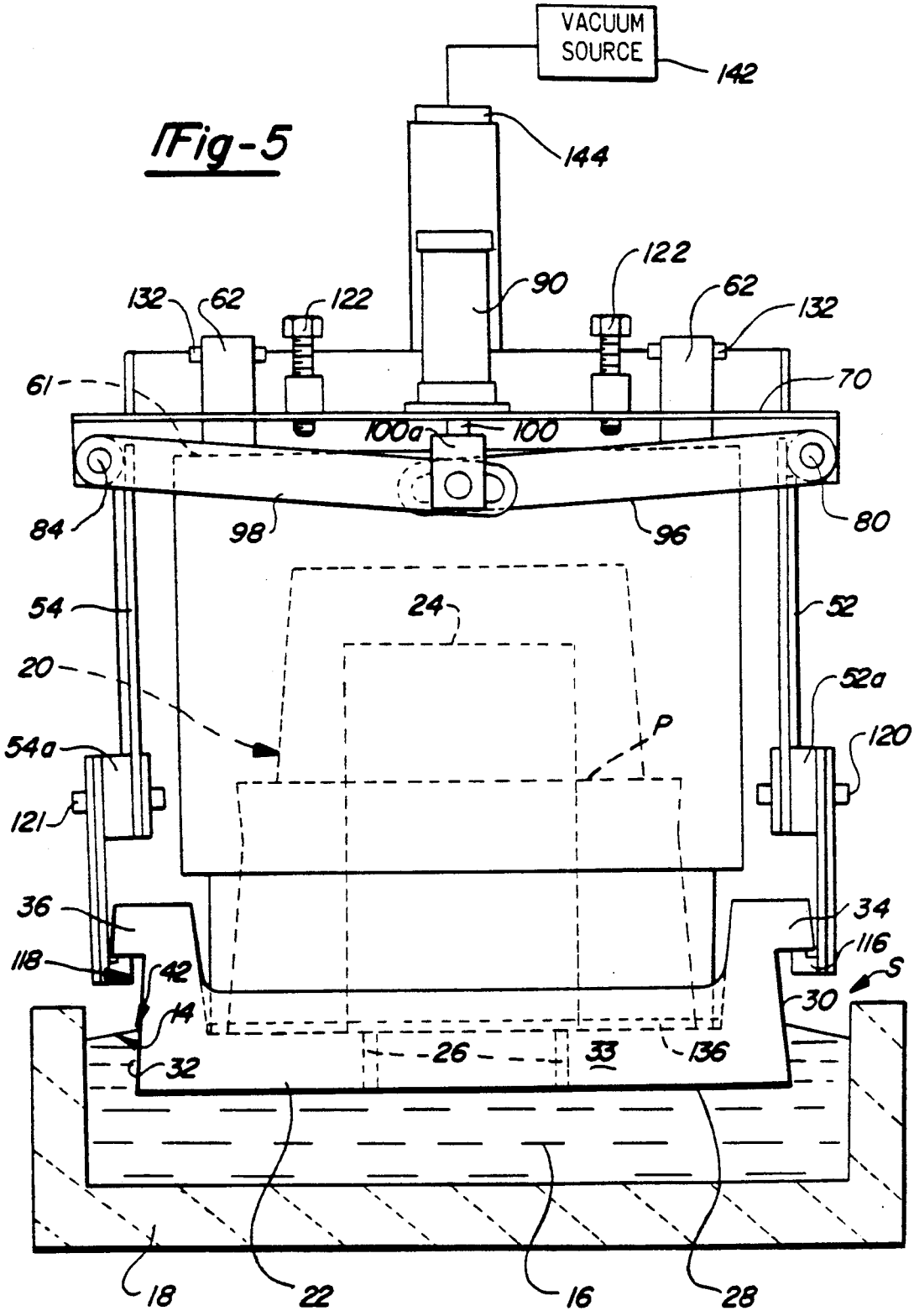
FIG. 5 is a front elevational view of the casting apparatus positioned at a casting station over a pool of melt with the lower mold member immersed in the pool.
Figure 6:
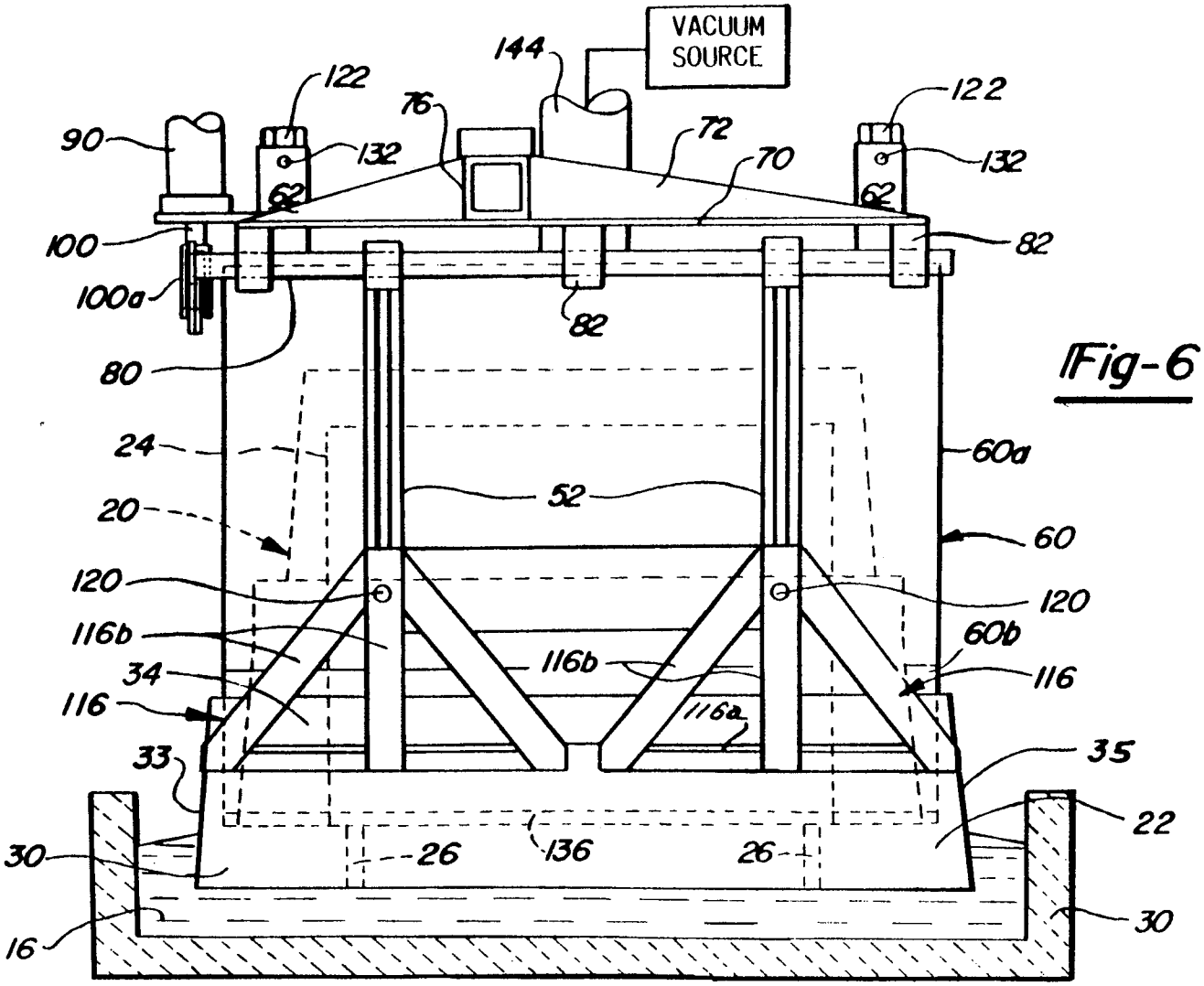
FIG. 6 is a side elevational view of FIG. 5.

FIG. 1 illustrates one embodiment of a vacuum-assisted, countergravity casting apparatus of the invention. In particular, FIG. 1 depicts a casting mold 10 supported on a mold pick-up mechanism 12 which is, in turn, carried or mounted on a movable manipulating arm 14 (partially shown) of the type shown in the Chandley et al U.S. Pat. No. 4,340,108, the teachings of which are incorporated herein by reference. The manipulating arm 14 is adapted to transport the casting apparatus (i.e., mold 10 supported on the pick-up mechanism 12) to a casting station S comprising a pool 14 of melt 16 (e.g., molten metal) in a container 18 (FIGS. 5 and 6). The arm 14 is actuated at the casting station S to immerse the mold 10 in the melt 16 for countergravity casting the melt upwardly into the mold, withdraw the mold 10 from the melt 16 after casting, and thereafter transport the melt-filled mold 10 to a demold station (not shown) where the mold 10 and the pick-up mechanism 12 are disengaged to allow separation of the mold and the casting therein.

The casting mold 10 comprises a gas permeable upper mold member (cope) 20 disposed atop a lower mold member 22 (drag) at a horizontal parting plane P. One or more mold cavities 24 are formed at least partially in the upper mold member 20 and are communicated via one or more ingate passages 26 in the lower mold member 22 to the mold underside 28. The mold underside 28 is adapted to be immersed in the melt 16 during vacuum-assisted, countergravity casting (e.g., as shown in FIGS. 5 and 6) such that the melt 16 is drawn upwardly through the ingate passages 26 into the mold cavity 24 to fill the mold cavity with the melt. The upper and lower mold members 20,22 may be glued together at the parting plane P to minimize leakage of melt therebetween.

The upper mold member 20 typically comprises a gas permeable material (e.g., resin-bonded sand) which permits gases to be withdrawn from the mold cavity 24 during countergravity casting.

The lower mold member 22 may conveniently comprise the same material as the upper mold member 20 or other materials, gas permeable or impermeable, which are compatible with the material of the upper mold member 20. Portions **22*a*,22*b* of the lower mold member 22** may be made as one piece or two, vertically stacked pieces.

The lower mold member 22 includes first and second upstanding, lateral sides 30,32 that extend from the front side 33 to the rear side 35 thereof. In accordance with the present invention, the first and second lateral sides 30,32 include elongated, pick-up ledges 34,36 that extend from the front side 33 to the rear side 35 and are generally level (i.e., generally horizontal) in orientation. Each ledge 34,36 includes a laterally extending, downwardly facing, generally level pick-up surface **34*a*,36*a* adapted to be engaged by the pick-up mechanism 12** in a manner to be described hereinbelow.

The ledges 34,36 are spaced above the mold underside 28 to provide enough space for engagement by the mold pick-up mechanism 12 and yet leave a mold immersion zone 42 for immersion in the melt 16 during casting without risking contact of the pick-up mechanism 12 with the melt 16. Mold sides 33,35 extend above the mold underside 28 for the same reason.

The lower mold member 22 includes a top surface 44 on which the upper mold member 20 is supported to define the horizontal parting plane P therebetween. The mold sides 30,32,33,35 extend above the top surface 44 to, in effect, form an upstanding levee 45 therearound that isolates the parting plane P from the melt 16 during mold immersion as described in U.S. Pat. No. 4,745,926 of common assignee herewith. As will be explained hereinbelow, the levee 45 allows the lower mold member 22 to be immersed in the melt 16 to a depth where the upper melt level (melt meniscus) is above the parting plane P.

The upper and lower mold members 20,22 typically are each made in accordance with known mold practice where a compliant (shapeable) mixture of sand or equivalent particles and a settable binder material (e.g., an inorganic or organic thermal or chemical setting plastic resin) is formed to shape and then cured or hardened against respective contoured pattern plates (not shown) to form the various mold features illustrated in the figures, including the ledges 34,36 on the lower mold member 22. The mold pick-up ledges 34,36 are relatively simple in configuration and can be readily formed using such known mold practices.

Referring again to FIG. 1, the mold pick-up mechanism 12 comprises a support frame 50, a pair of first pick-up arms 52 and a pair of second pick-up arms 54 pivotally mounted on the support frame 50, and actuator means 56 for pivoting the pick-up arms 52,54 relative to the upstanding sides 30,32 of the casting mold 10. A vacuum box 60 is relatively movably mounted on the support frame 50 via a plurality of posts 62. As is apparent, the support frame 50 overlies the top 61 of the vacuum box 60 and the pick-up arms 52,54 are positioned laterally adjacent opposite, upstanding sides 64,66 of the vacuum box 60 such that, in effect, the pick-up mechanism 12 straddles the vacuum box 60 for purposes to be explained hereinbelow.

Figure 3:
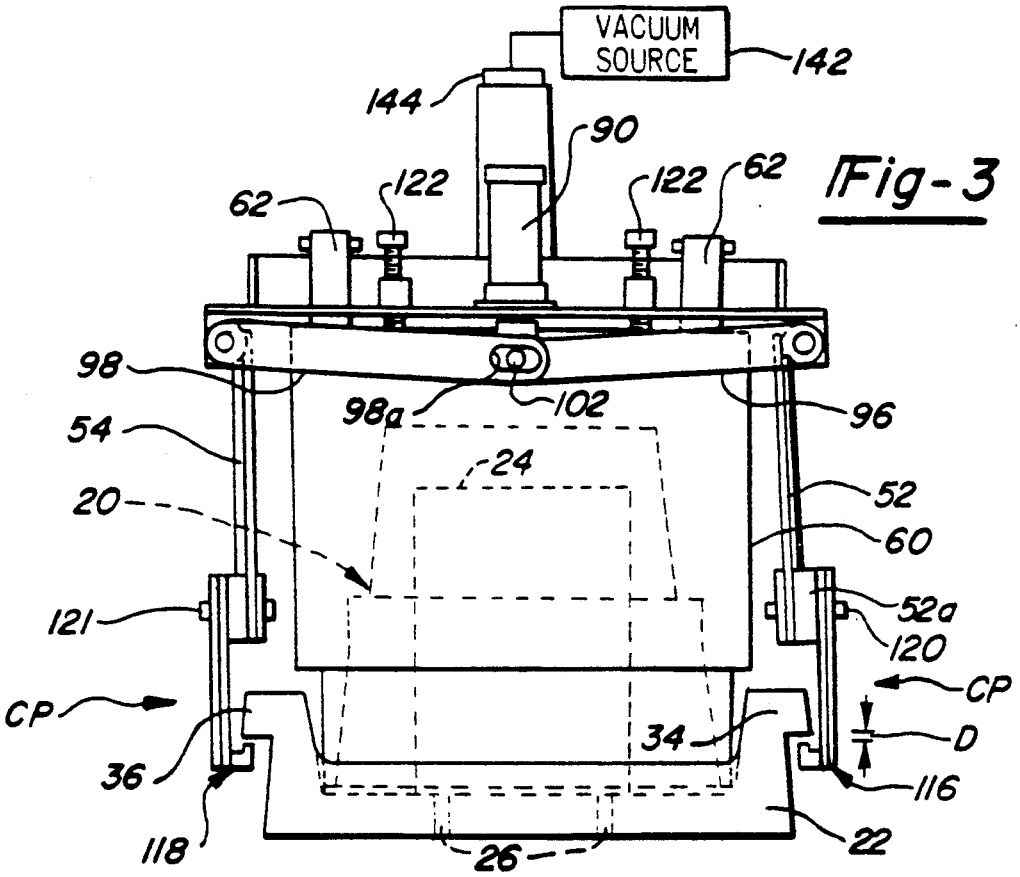
FIG. 3 is an elevational view similar to FIG. 2 after the pick-up arms are moved to the closed positions proximate the mold sides to position the pick-up feet beneath the mold ledges.
Figure 4:
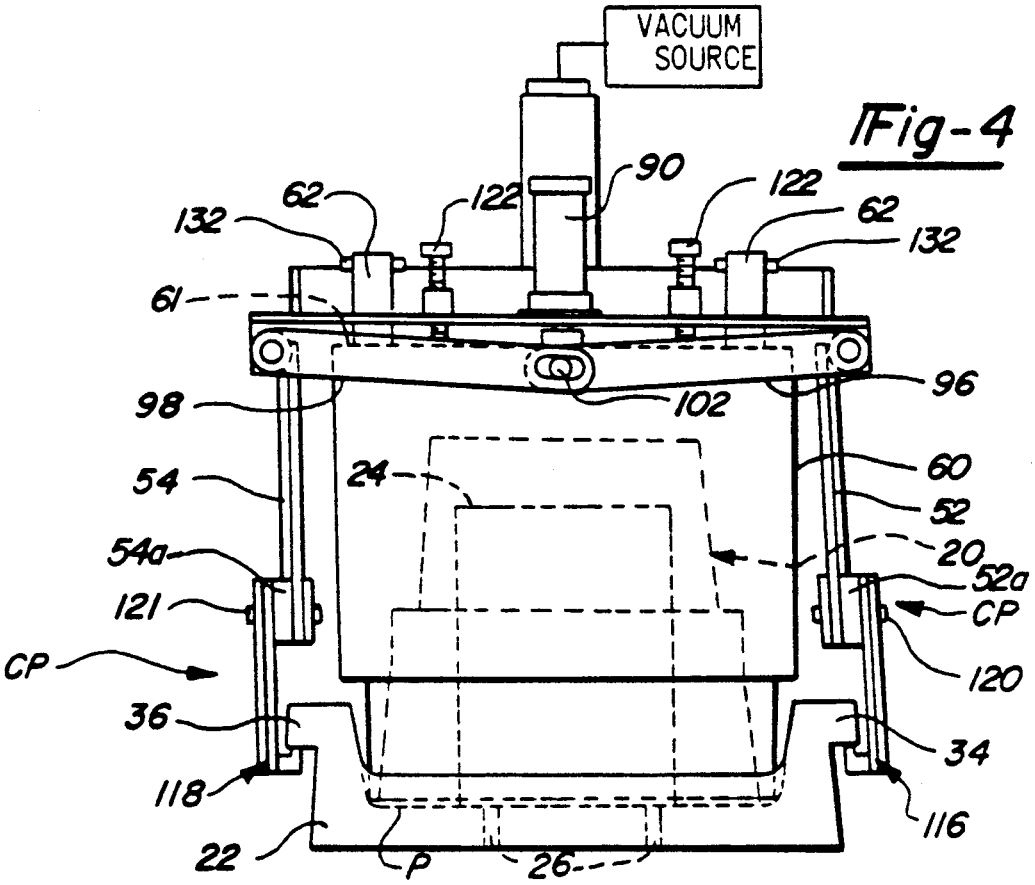
FIG. 4 is an elevational view similar to FIG. 3 after the pick-up feet are supportively engaged to the mold ledges as a result of movement of the pick-up mechanism away from the mold.

The support frame 50 includes a horizontal support member 70, upstanding side support members 72,74 and an intermediate support beam member 76. The support beam member 76 is connected to the manipulating arm 14 via connector member 78 which is bolted or otherwise fastened to the manipulating arm 14. The pick-up arms 52 are mounted on a horizontal pivot shaft 80 which, in turn, is pivotally mounted on the support member 70 by a plurality of axially spaced apart bearing blocks 82 affixed to the underside of the support member 70. The pick-up arms 54 are similarly pivotally mounted on the support member 70 by a pivot shaft 84 and a plurality of axially spaced apart bearing blocks 86 (only one shown). It is apparent that pivot shafts 80,84 define spaced apart horizontal, parallel pivot axes disposed outboard of the mold sides 30,32. In this way, the pick-up arms 52,54 are pivotally mounted on the support frame 50 for pivotal movement to and fro between open positions (OP) remote from the mold sides 30 32 (FIG. 2) and closed positions (CP) proximate the mold sides 30,32 (FIGS. 3 and 4).

The pick-up arms 52,54 are moved between the open positions (OP) and the closed positions (CP) by the actuator means 56. Actuator means 56 comprises a fluid actuator 90, such as an air or hydraulic cylinder/piston, and first and second levers 96,98. The actuator 90 is mounted on the support member 70 via cantilevered plate 92. The outboard ends of the levers 96,98 are interconnected to the respective pivot shaft 80,84 by press fit or other fastening means whereas the inboard ends of the levers 96,98 are interconnected to a clevis 100*a* of the actuator plunger 100 via a common pin 102. The pin 102 is received in axial slots 96*a*,98*a* in the inboard ends of the levers 96,98 such that extension of the plunger 100 downwardly effects rotation of the pivot shafts 80,84 to position the pick-up arms 52,54 in the open positions (OP) and retraction of the actuator plunger 100 effects rotation of the pivot shafts 96,98 to position the pick-up arms 52,54 in the closed positions (CP).

The pick-up arms 52 are interconnected at their lower ends by a cross brace 110 so that they move in unison when the plunger 100 is extended/retracted. The pick-up arms 54 are similarly interconnected by a cross brace 112.

The pick-up arms 52 each include a respective pick-up foot 116 pivotally mounted thereon by a pivot pin 120. In particular, each pick-up foot 116 is mounted on a pivot pin 120 for pivotal movement relative to fixed support block 52*a* on arms 52. The pick-up feet 116 are elongated in the same direction as the mold ledge 34 to provide a collective pick-up foot length corresponding generally to the length of the mold ledge 34 whereby the pick-up feet 116 will engage substantially the full length of the ledge 34 (i.e., from the front to the rear of the lower mold member) when the pick-up mechanism 12 supports the mold 10. The pick-up arms 54 include like elongated pick-up feet 118 pivotally mounted on like fixed support blocks 54*a* by pivot pins 121 for engaging substantially the full length of the mold ledge 36 when the pick-up mechanism 12 supports the mold 10. In this way, the weight of the mold 10 is distributed over a large surface area to reduce localized stresses on the mold. Pivotal mounting of the pick-up feet 116, 118 allows accommodation of any unevenness (out of level) of the mold ledges 34,36 from one mold to the next present as a result of the mold fabrication process employed as well as any unparallelism between a ledge and its associated foot before the foot engages therewith.

The pick-up feet 116,118 each include an elongated, engagement flange 116*a*,118*a* that is adapted to engage the respective mold ledge surface 34*a*,36*a* in the manner described hereinabove. Each flange 116*a*,118*a* is fixedly connected (e.g., welded) to the respective pick-up arm 52,54 by connector members 116*b*,118*b* as shown in the figures.

A plurality of adjustment screws 122 are threadably received in corresponding mounts 123 affixed to the support member 70 as shown best in FIG. 1. The adjustment screws 122 are adapted to engage the top 61 of the vacuum box 60 to control positioning of the pick-up feet 116,118 a predetermined distance beneath the mold ledges 34,36 in a manner to be described hereinbelow.

The vacuum box 60 is mounted on the support member 70 via the posts 62. The posts 62 are affixed (e.g., welded) to the top 61 of the vacuum box and extend with clearance through corresponding openings 130 in the support member 70 such that the vacuum box and pick-up mechanism 12 are relatively vertically movable to one another for reasons to be explained. The posts 62 each include a cross pin 132 that supports or suspends the vacuum box 60 from the support member 70 (see FIG. 2) when the pick-up mechanism 12 is positioned above the casting mold 10 out of engagement therewith.

Figure 2:
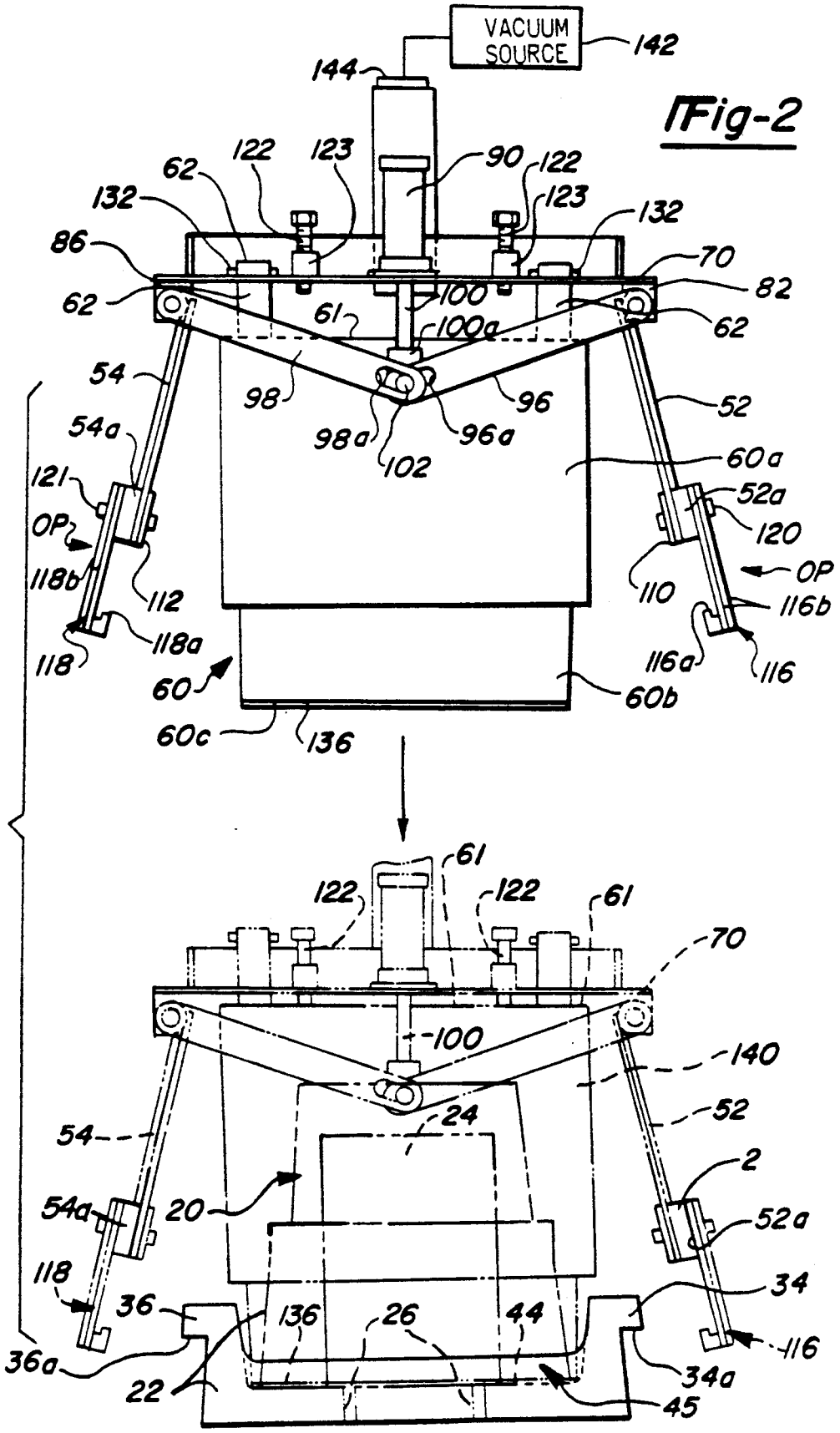
FIG. 2 is a front elevational view of the casting apparatus with the pick-up mechanism shown initially (in solid lines) positioned above the casting mold and shown subsequently (in phantom lines) lowered to position a vacuum box thereon about the upper mold member and the open pick-up arms laterally adjacent the mold sides.

Referring to FIG. 2, the vacuum box 60 includes an upper section 60*a* and a smaller lower section 60*b* that define a bottom lip 60*c*. The bottom lip 60*c* carries a gasket seal 136 that is adapted to engage and seal on the top surface 44 of the lower mold member 22 when the mold 10 and pick-up mechanism 12 are operatively engaged for casting.

The vacuum chamber 140 defined within the vacuum box 60 is connectable to a source of reduced pressure 142, such as a vacuum pump, via a conduit 144 extending from the top 61 of the vacuum box. As will be explained hereinbelow, the vacuum chamber 140 is evacuated sufficiently to draw the melt 16 upwardly into the mold cavity 24 when the underside 28 of the lower mold member 22 is immersed therein.

FIGS. 2 through 6 illustrate operation of the casting apparatus in the vacuum-assisted, countergravity casting of the melt 16 into the mold 10. In particular, referring first to FIG. 2, the mold pick-up mechanism 12 is shown in solid lines positioned above the casting mold 10 out of engagement therewith. In this position, the vacuum box 60 is suspended from the support member 70 by the cross pins 132 of the posts 62. The casting mold 10 is supported on a suitable table (not shown).

The casting apparatus is then lowered (by manipulating arm 14) toward the mold 10 with the pick-up arms 52,54 in the open positions (OP) to engage or seat the vacuum box seal 136 on the lower mold member 22 and to engage (bottom out) the adjustment screws 122 on the top 61 of the seated vacuum box 60 as shown in phantom lines in FIG. 2. The weight of the vacuum box 60 provides sufficient pressure on the gasket seal to effect a sealing action with the top surface 44. Moreover, once the vacuum chamber 140 is evacuated during casting, ambient pressure will assist in further compressing the seal 136 to provide the desired sealing action.

Engagement of the adjustment screws 122 with the top 61 of the vacuum box 60 positions the opened pick-up arms 52,54 laterally adjacent the mold sides 30,32 such that the pick-up feet 116,118 will be positioned a predetermined distance D beneath the mold ledges 34,36 (see FIG. 3) when the pick-up arms 52,54 are subsequently pivoted to the closed positions (CP) (by the actuator 90). FIG. 3 shows the position of the pick-up feet 116,118 after the actuator 90 pivots the pick-up arms 52,54 to the closed positions CP. It is apparent that the pick-up feet 116,118 are located below the ledges 34,36 a distance D determined by engagement of the adjustment screws 122 with the top 61 of the vacuum box 60.

The pick-up mechanism 12 is then raised (by manipulating arm 14) away from the casting mold 10 so as to cause the pick-up feet 116,118 to supportively engage the ledges 34,36 to thereby carry the mold 10 with the vacuum box 60 confronting the upper mold member 20. This upward movement of the pick-up mechanism 12 also causes the adjustment screws 122 to disengage from the top 61 of the vacuum box 60 as shown in FIG. 4. In particular, the adjustment screws 120 are spaced above the top 61 by the predetermined distance D.

The manipulating arm 14 is then actuated to transport the pick-up mechanism 12/mold 10/vacuum box 60 to the casting station S where the casting apparatus is lowered toward the melt 16 to immerse the lower mold member 22 therein as shown in FIGS. 5 and 6. The lower mold member 22 is immersed along the mold immersion zone 42 defined between the pick-up feet 116,118 and the mold underside 28. The vacuum chamber 140 is then evacuated (by vacuum source 142) to sufficiently reduce the pressure in the mold cavity 24 to draw the melt 16 upwardly through the ingate passages 26 into the mold cavity to fill it with the melt. As a result of the spacing of the ledges 34,36 considerably above the mold underside 28, the lower mold member 22 can be immersed deep into the melt 16 to enhance the reduced pressure (vacuum) level achievable in the mold cavity 24 while avoiding harmful contact of the pick-up feet 116,118 with the melt 16. Similarly, levee 45 avoids harmful contact between the melt 16 and the parting plane P. Achievement of increased vacuum levels in the mold cavity 24 during casting improves mold filling, reduces mold fill time and reduces the incidence of casting defects.

Following filling of the mold cavity 24 with the melt 16 and initial solidification of the melt in the ingate passages 26, the manipulating arm 14 is actuated to raise the casting apparatus so as to withdraw the lower mold member 22 out of the melt for transport to a demold station (not shown). The number and size of the ingate passages 26 to achieve solidification initially thereat can be selected in accordance with the teachings of U.S. Pat. No. 4,340,108, the teachings of which have been incorporated herein by reference. Alternately, the melt 16 can be allowed to solidify in both the ingate passages 26 and the mold cavity 24 before raising the lower mold member 22 out of the melt 16.

At the demold station, the manipulating arm 14 is lowered to place the melt-filled mold 10 on a suitable stationary support (e.g., a mold shake-out grate). The arm 14 is lowered until the adjustment screws 122 bottom out on the top 61 of the vacuum box 60 (in a manner similar to that shown in phantom lines in FIG. 2). Such engagement of the adjustment screws 122 positions the pick-up feet 116,118 the predetermined distance D beneath the mold ledges 34,36 so that the pick-up arms 52,54 can then be pivoted (by actuator 90) to the open positions (OP) to free the mold from the pick-up mechanism 12. The arm 14 is then raised to lift the pick-up mechanism 12 above the mold 10 (in a manner similar to that shown in solid lines in FIG. 2). The pick-up mechanism 12 can then be used to pick up another empty casting mold 10 to repeat the casting cycle. The mold 10 and the casting therein can then be separated.

While the invention has been described in terms of specific embodiments thereof, it is not intended to be limited thereto but rather only to the extent set forth hereafter in the following claims.

We claim:

1. Casting apparatus, comprising:

a) a casting mold including first and second upstanding sides having a respective first and second elongated ledge disposed thereon in a generally level orientation, a mold pick-up mechanism comprising 1) first and second pick-up arms each movable relative to the respective first and second sides between an open position remote therefrom and a closed position proximate thereto, said first and second pick-up arms each including an elongated pick-up foot thereon for engaging a said ledge, each pick-up foot being pivotally mounted on a said pick-up arm to accommodate any uneveness along the ledge or unparallelism between the ledge and the pick-up foot before the pick-up foot engages therewith so as to provide substantially uniform distribution of said mold's weight over said ledges and 2) means operatively associated with said arms for moving them to and fro relative to said sides, c) means for relatively mOVing the mold and the pick-up mechanism toward one another with said pick-up arms in the open positions so as to position the pick-up arms laterally adjacent the mold sides such that movement of the pick-up arms to the closed positions proximate said mold sides positions the pick-up feet beneath the ledges, and d) means for relatively moving the mold and the pick-up mechanism away from one another to engage the pick-up feet with the ledges thereabove to thereby support the mold on the pick-up mechanism.

2. Apparatus for the vacuum, countergravity casting of a melt, comprising:

a) a mold having first and second upstanding sides and an underside adapted for engaging an underlying source of the melt, said first and second sides including a respective first and second ledge disposed thereon in a generally level orientation, b) a vacuum box confronting an upper portion of the mold so as to leave the first and second ledges outboard said box, and c) a mold pick-up mechanism straddling the vacuum box for engaging and carrying the mold to said source to engage the mold underside and the source, said pick-up mechanism comprising 1) first and second pick-up arms each movable relative to the respective first and second sides between an open position remote therefrom and a closed position proximate thereto, said first and second pick-up arms including a respective first and second pick-up foot for engaging the respective first and second ledge, each pick-up foot being pivotally mounted on its associated pick-up arm and 2)

means operatively associated with each of the first and second arms for moving them to and fro relative to the respective first and second mold sides, d) means for relatively moving the mold and the pick-up mechanism toward one another with said pick-up arms in the open positions so as to position the pick-up arms laterally adjacent the mold sides such that movement of the pick-up arms to the closed position proximate said mold sides positions the pick-up feet beneath the ledges, and e) means for relatively moving the mold and the pick-up mechanism away from one another to engage the pick-up feet with the ledges thereabove to thereby support the mold on the pick-up mechanism with the vacuum box confronting the upper mold portion.

3. The apparatus of claim 2 wherein the first and second pick-up arms are pivotably mounted on the pick-up mechanism.

4. The apparatus of claim 3 wherein the first and second pick-up arms pivot about respective first and second parallel, horizontal pivot axes located outboard of the respective first and second sides of the mold.

5. The apparatus of claim 4 wherein the pick-up feet pivot about horizontal pivot axes that extend in a direction perpendicular to the pivot axes of said pick-up arms.

6. The apparatus of claim 4 including means for pivoting the first and second arms about said axes, said pivoting means comprising first and second levers operatively connected at respective outboard ends to the respective first and second arms and operatively connected at respective inboard ends to a common actuator such that movement of the inboard ends effects pivoting movement of said pick-up arms.

7. The apparatus of claim 2 wherein the mold comprises a lower mold member and an upper mold member disposed atop the lower mold member.

8. The apparatus of claim 7 wherein the vacuum box is engaged to the lower mold member and encloses the upper mold member.

9. The apparatus of claim 7 wherein the lower mold member includes said first and second upstanding sides having said first and second ledges thereon.

10. The apparatus of claim 9 wherein the first and second ledges extend substantially from a front to a rear of the lower mold member.

11. The apparatus of claim 9 wherein the first and second ledges each include a laterally extending, downwardly facing surface for engagement by the respective pick-up foot.

12. The apparatus of claim 11 wherein each pick-up foot includes a lateral flange for engagement with the respective ledge surface.

13. The apparatus of claim 2 wherein the first and second ledges are spaced above the mold underside to provide a melt immersion zone.

14. The apparatus of claim 2 wherein the means for relatively moving the mold and the pick-up mechanism toward/away from one another comprises an actuator operatively connected to the pick-up mechanism for lowering/raising it relative to the mold.

15. Apparatus for the vacuum, countergravity casting of a melt, comprising:

a) a casting mold having first and second upstanding sides and an underside adapted for engaging an underlying source of the melt, said first and second sides including a respective first and second elongated ledge disposed thereon in a generally level orientation, b) a mold pick-up mechanism comprising 1) first and second pick-up arms each movable relative to the respective first and second sides between an open position remote therefrom and a closed position proximate thereto, said first and second pick-up arms including a respective first and second elongated pick-up foot for engaging the respective first and second ledge, each pick-up foot being pivotally mounted on the respective pick-up arm to accommodate any unevenness along the ledge or unparallelism between the ledge and the pick-up foot before the pick-up foot engages therewith so as to provide substantially uniform distribution of said mold's weight over said ledges and 2) means operatively associated with each of the first and second pick-up arms for moving them relative to said respective first and second mold sides, c) a vacuum box confronting an upper portion of the mold so as to leave the first and second )edges outboard said box and engageable by said feet, said vacuum box being relatively movably mounted on the pick-up mechanism such that the vacuum box initially engages the mold so as to confront the upper portion thereof as the pick-up mechanism and the mold are relatively moved toward one another with the pick-up arms positioned in the open positions and such that the open pick-up arms are positioned laterally adjacent the mold sides with continued relative movement of the mold and pick-up mechanism toward one another, said pick-up arms being positioned laterally adjacent the mold sides so that movement of the pick-up arms to the closed positions proximate the mold sides will position the respective first and second pick-up feet beneath the respective first and second ledges, d) means for relatively moving the mold and the pick-up mechanism toward one another while said pick-up arms are in the open positions to initially engage the vacuum box and the mold and then to position the open first and second pick-up arms laterally adjacent said first and second sides whereupon said pick-up arms are moved to the closed positions proximate the mold sides to position the first and second pick-up feet beneath the respective first and second ledges, and e) means for relatively moving the mold and the pick-up mechanism away from one another while the vacuum box remains engaged to the mold so as to engage the pick-up feet with the ledges thereabove to thereby support the mold on said pick-up mechanism with the vacuum box confronting said upper mold portion for transport to said source, said pick-up feet pivoting on the respective pick-up arm as necessary to accommodate any unparallelism between the ledges and said feet.

16. The apparatus of claim 15 wherein said pick-up mechanism includes adjustable stop means for engaging the vacuum box so as to locate the pick-up feet a predetermined distance beneath the ledges when the pick-up arms are moved to the closed positions proximate the mold sides.

* * * * *